US009643040B1

(12) United States Patent
Guerrero Diaz

(10) Patent No.: US 9,643,040 B1
(45) Date of Patent: May 9, 2017

(54) MODULAR ENDURANCE CONDITIONING TANK SYSTEM AND METHOD

(71) Applicant: Juan David Guerrero Diaz, Phoenix, AZ (US)

(72) Inventor: Juan David Guerrero Diaz, Phoenix, AZ (US)

( * ) Notice: Subject to any disclaimer, the term of this patent is extended or adjusted under 35 U.S.C. 154(b) by 0 days.

(21) Appl. No.: 15/213,357

(22) Filed: Jul. 18, 2016

Related U.S. Application Data

(60) Provisional application No. 62/198,472, filed on Jul. 29, 2015.

(51) Int. Cl.

| | |
|---|---|
| ***A63B 22/00*** | (2006.01) |
| ***A63B 21/00*** | (2006.01) |
| ***A63B 21/072*** | (2006.01) |
| ***A63B 23/04*** | (2006.01) |
| ***A63B 23/12*** | (2006.01) |

(52) U.S. Cl.
CPC .... *A63B 21/0004* (2013.01); *A63B 21/00069* (2013.01); *A63B 21/0724* (2013.01); *A63B 21/4005* (2015.10); *A63B 21/4035* (2015.10); *A63B 23/047* (2013.01); *A63B 23/12* (2013.01)

(58) Field of Classification Search
USPC ..... 482/1–148
See application file for complete search history.

(56) References Cited

U.S. PATENT DOCUMENTS

| | | | | |
|---|---|---|---|---|
| 1,560,928 | A * | 11/1925 | Wolpert | B62B 13/04 280/14.28 |
| 3,062,548 | A * | 11/1962 | Foster | A63B 69/345 434/251 |
| 5,810,697 | A | 9/1998 | Joiner | |
| 6,217,487 | B1 | 4/2001 | Reinert | |
| 6,685,581 | B2 * | 2/2004 | Krause | A63B 69/004 473/441 |
| 6,942,585 | B1 * | 9/2005 | Krause | A63B 69/002 473/441 |
| 7,322,905 | B2 * | 1/2008 | Morris | A63B 69/345 482/118 |
| 7,416,412 | B2 * | 8/2008 | Segrest | G09B 19/00 434/226 |

(Continued)

*Primary Examiner* — Stephen Crow
(74) *Attorney, Agent, or Firm* — Integrity Patent Group, PLC; Edwin Wold

(57) ABSTRACT

A modular endurance conditioning tank system for multi-activity strength and endurance training, over a plurality of surfaces and terrain, that reduces the risk of athlete injury. The modular endurance conditioning tank assembly is useful for manually-maneuvering a steel chassis/frame assembly while applying varying amounts of weights and resistance for athletic strength and endurance conditioning. The modular endurance conditioning tank assembly may include a steel chassis/frame assembly, at least one wheeled continuous-track system, at least one steel shaft, a T-shaped handle, at least one hand-hold receiver, a barbell-weight plate receptacle, and a complementary strap, harness, and alternatively user-worn apparel. The steel chassis/frame assembly may have at least one wheeled continuous-track system and the at least one wheeled continuous-track system may further have a left-track assembly, a right-track assembly, and a double wheel disc brake system. Further, the double wheel disc brake system may include a resistance adjusting knob.

19 Claims, 5 Drawing Sheets

(56) References Cited

U.S. PATENT DOCUMENTS

| | | | | |
|---|---|---|---|---|
| 7,727,089 | B2 * | 6/2010 | Gilman | A63B 21/06 473/441 |
| 8,469,861 | B1 | 6/2013 | McFee et al. | |
| 8,617,007 | B2 | 12/2013 | Gilman | |
| 8,770,615 | B2 * | 7/2014 | Bar Noy | A61G 1/013 280/640 |
| 8,845,497 | B2 * | 9/2014 | Turner | A63B 21/00069 482/115 |
| 8,960,678 | B2 * | 2/2015 | Gilman | A63B 69/345 273/445 |
| 9,186,538 | B1 * | 11/2015 | Seen | A63B 21/072 |
| 9,192,803 | B2 * | 11/2015 | Cayo | A63B 21/0618 |
| 9,446,281 | B2 * | 9/2016 | Abelbeck | A63B 21/0601 |
| 2002/0086780 | A1 * | 7/2002 | Morris | A63B 69/345 482/136 |
| 2005/0184478 | A1 | 8/2005 | Ruedy | |
| 2011/0224050 | A1 * | 9/2011 | Larish | A63B 21/015 482/93 |
| 2013/0012364 | A1 | 1/2013 | Leath | |
| 2014/0073491 | A1 * | 3/2014 | Gilson | A63B 21/06 482/93 |
| 2016/0361584 | A1 * | 12/2016 | Towley | A63B 21/06 |

* cited by examiner

MODULAR ENDURANCE CONDITIONING TANK SYSTEM AND METHOD

CROSS-REFERENCE TO RELATED APPLICATION

The present application is related to and claims priority from prior provisional application Ser. No. 62/198,472, filed Jul. 29, 2015 which application is incorporated herein by reference.

BACKGROUND OF THE DISCLOSURE

The following includes information that may be useful in understanding the present disclosure(s). It is not an admission that any of the information provided herein is prior art, or material, to the presently described or claimed disclosures, or that any publication or document that is specifically or implicitly referenced is prior art.

1. Field of the Disclosure

The present disclosure relates generally to the field of fitness and exercise equipment and more specifically relates to a modular endurance conditioning tank (tracked) system.

2. Description of Related Art

Human strength and endurance training is popular for many sports and physical activities. Strength training is a type of physical exercise specializing in the use of resistance to create muscle contractions to build strength, endurance, and the size of skeletal muscles. Strength training can provide significant benefits and improvements in overall health and well-being, including increased bone, muscle, tendon and ligament strength, improved joint function, reduced potential for injury, increased bone density, metabolism, and fitness, improved cardiac function and lipoprotein lipid profiles (including elevated HDL ("good") cholesterol).

Strength training often incorporates the method of progressively increasing the output of a muscle via incremental increases in weight resistance. Strength training may also use a variety of exercises and types of equipment to target specific muscle groups. Sports where strength training is central are bodybuilding, weightlifting, powerlifting, and other sports that use strength training as part of their training regimen may include American football, wrestling, track and field, rowing, lacrosse, basketball, hockey and football.

Endurance training may be accomplished by exercising to increase the length of time that an athlete can perform an activity or activities. The need for endurance in sports is often predicated as the need of cardiovascular and simple muscular endurance and can be described as general endurance and specific endurance. Specific endurance may be used in activities such as running marathons or completing triathlons. A well-conditioned athlete can perform consistently and effectively with the least amount effort after proper endurance training. Heavy objects such as tractor tires to flip or push, weighted bars, or metal stands to jump up on to are examples of types of equipment and techniques available for athletes who wish to combine both strength and endurance training. A suitable solution is desired.

Several attempts have been made to solve the above-mentioned problems such as those found in U.S. Pat. No. 8,617,007 to Gilman; U.S. Pat. No. 5,810,697 to Joiner; 2013/0012364 to Leath; 2005/0184478 to Ruedy; U.S. Pat. No. 8,469,861 to McFee et al.; and U.S. Pat. No. 6,217,487 to Reinert. This art is representative of fitness and exercise equipment. However, none of the above disclosures and patents, taken either singly or in combination, is seen to describe the disclosure as claimed.

BRIEF SUMMARY OF THE DISCLOSURE

In view of the foregoing disadvantages inherent in the known fitness and exercise equipment art, the present disclosure provides a novel modular endurance conditioning tank system mounted on tracks. The general purpose of the present disclosure, which will be described subsequently in greater detail is to provide a multi-activity strength and endurance apparatus that reduces the risk of athlete injury, with minimal instruction, over a plurality of surfaces and terrain.

A modular endurance conditioning tank system is disclosed herein, in a preferred embodiment, comprising a modular endurance conditioning tank assembly. The modular endurance conditioning tank assembly is useful for manually-maneuvering a steel chassis/frame assembly while applying (carrying) varying amounts of weights and resistance for athletic strength and endurance conditioning.

The modular endurance conditioning tank assembly may comprise in functional and structural combination the steel chassis/frame assembly, the at least one wheeled continuous-track system, at least one steel shaft, the T-shaped handle, the at least one hand-hold receiver, the barbell-weight plate receptacle, and the complementary strap, harness, and/or the user-worn apparel. The steel chassis/frame assembly may comprise at least one wheeled continuous-track system and the at least one wheeled continuous-track system may further comprise a left-track assembly, a right-track assembly, and a double wheel disc brake system. Further, the double wheel disc brake system may comprise a resistance adjusting knob.

In continuing to refer to the at least one wheeled continuous-track system, the at least one wheeled continuous-track system may comprise a first-continuous band of tread, which may be structured and arranged rotate about the left-track assembly, and a second-continuous band of tread, which may be structured and arranged to rotate about the right-track assembly. The first-continuous band of tread and the second-continuous band of tread are configured to enable rotational motion of the modular endurance conditioning tank assembly. Further, the left track assembly may comprise a first at least two rubberized and steel wheels and the right-track assembly may comprise a second at least two rubberized and steel wheels. The first at least two rubberized and steel wheels and the second at least two rubberized and steel wheels are structured and arranged to engage in a manner to propel the modular endurance conditioning tank assembly (when pulled).

The first at least two rubberized and steel wheels may comprise the first-forward wheel and the first-rear wheel and the second at least two rubberized and steel wheels may comprise the second-forward wheel and the second-rear wheel. The first-forward wheel, the first-rear wheel, the second-forward wheel, and the second-rear wheel are structured and arranged in the square configuration to frame the steel chassis/frame assembly. Further, the first at least two rubberized and steel wheels and second at least two rubberized and steel wheels may comprise a plurality of roller bearings, which are useful for enabling a rotational motion of the first at least two rubberized and steel wheels and second at least two rubberized and steel wheels. The first at least two rubberized and steel wheels and second at least two rubberized and steel wheels may further comprise sprockets structured and arranged to mate with the at least one continuous band of tread such that the modular endurance conditioning tank system is allowed to be propelled in a forward, and alternatively, a backward direction. Further, the first at least two rubberized and steel wheels and second at least two rubberized and steel wheels may comprise at least one bolt (or other suitable fastener) useful for retaining the first at least two rubberized and steel wheels and the second at least two rubberized and steel wheels to the steel chassis/frame assembly.

The double wheel disc brake system may comprise a cable useful for actuating mechanical braking of the modular endurance conditioning tank assembly. The double wheel disc brake system may further comprise at least one caliper useful for frictionally-decelerating the first at least two rubberized and steel wheels and second at least two rubberized and steel wheels. The resistance adjusting knob is structured and arranged to manually apply increased and alternatively decreased resistance equally to the first at least two rubberized and steel wheels and the second at least two rubberized and steel wheels useful for creating a customizable training experience.

The steel chassis/frame assembly may comprise the at least one steel shaft and the T-shaped handle, useful for performing lifting and flipping exercises. The at least one hand-hold receiver is structured and arranged to removably-couple with the plurality of steel rods, useful for pushing the modular endurance conditioning tank assembly across a substantially planar surface.

The barbell-weight plate receptacle may comprise a plate, a steel pole, and a clamp that are configured to place at least one barbell-weight over the steel pole until the at least one barbell-weight is coupled with the plate, and secure the at least one barbell-weight with the clamp in a manner useful for increasing the overall weight of the modular endurance conditioning tank assembly. The complementary strap, harness, and alternatively user-worn apparel is structured and arranged to allow a user to removably-couple with the modular endurance conditioning tank assembly in a hands-free manner to enable the user to maneuver the modular endurance conditioning tank assembly while walking, jogging, and alternatively running.

The modular endurance conditioning tank system may comprise a kit including the steel chassis/frame assembly; the plurality of steel rods; the complementary strap, harness, and alternatively body apparel; and a set of user instructions.

A method of using a modular endurance conditioning tank system may comprise the steps of: step one, installing a plurality of steel rods in an at least one hand-hold receiver; step, two, adding at least one barbell-weight to a barbell-weight plate receptacle; step three, lifting a steel chassis/frame assembly with a U-shaped handle and alternatively a T-shaped handle; step four, flipping the steel chassis/frame assembly with the at least one steel shaft and alternatively the T-shaped handle; step five, applying increased and alternatively decreased resistance equally to a first at least two rubberized and steel wheels and a second at least two rubberized and steel wheels via a resistance adjusting knob; step six, propelling the steel chassis/frame assembly in a forward and alternatively a backward direction across a surface; and step seven, actuating mechanical braking using a double wheel disc brake system as desired. The method further may comprise the steps of: step eight, detaching the plurality of steel rods from the at least one hand-hold receiver; step nine, uncoupling the at least one barbell-weight from the barbell-weight plate receptacle; and step ten, removing increased and alternatively decreased resistance equally from the first at least two rubberized and steel wheels and the second at least two rubberized and steel wheels via the resistance adjusting knob.

The present disclosure holds significant improvements and serves as a modular endurance conditioning tank system. Preferably, fitness and exercise equipment should provide multi-activity strength and endurance apparatus that reduces the risk of athlete injury, with minimal instruction, over a plurality of surfaces and terrain and, yet would operate reliably and be manufactured at a modest expense. Thus, a need exists for a reliable modular endurance conditioning tank system to avoid the above-mentioned problems.

For purposes of summarizing the disclosure, certain aspects, advantages, and novel features of the disclosure have been described herein. It is to be understood that not necessarily all such advantages may be achieved in accordance with any one particular embodiment of the disclosure. Thus, the disclosure may be embodied or carried out in a manner that achieves or optimizes one advantage or group of advantages as taught herein without necessarily achieving other advantages as may be taught or suggested herein. The features of the disclosure which are believed to be novel are particularly pointed out and distinctly claimed in the concluding portion of the specification. These and other features, aspects, and advantages of the present disclosure will become better understood with reference to the following drawings and detailed description.

BRIEF DESCRIPTION OF THE DRAWINGS

The figures which accompany the written portion of this specification illustrate embodiments and method(s) of use for the present disclosure, modular endurance conditioning tank system, constructed and operative according to the teachings of the present disclosure.

The various embodiments of the present disclosure will hereinafter be described in conjunction with the appended drawings, wherein like designations denote like elements.

DETAILED DESCRIPTION

As discussed above, embodiments of the present disclosure relate to fitness and exercise equipment and more particularly to a modular endurance conditioning tank system as used to improve the multi-activity strength and endurance apparatus that reduces the risk of athlete injury, with minimal instruction, over a plurality of surfaces and terrain.

Generally speaking, the modular endurance conditioning tank system (also known as "MELT"), comprises a workout machine that may work similarly to a prowler sled. An exercise-user is able to add or remove weights and increase or decrease tread resistance for customizing a workout routine. The modular endurance conditioning tank system is a strength training and endurance training exercise device, which may comprise a metal chassis, and which may be pushed or pulled by an athlete.

The modular endurance conditioning tank system may comprise at least one rubber-treaded wheel which may have adjustable levels of resistance via use of weight(s) stacked on top of the push sled. Alternatively, a braking system may be directly applied to at least one wheel for creating frictional resistance. Another activity such as flipping the device may be accomplished due to its horizontally symmetrical design. An additional exercise is one where the athlete may either jump on to or over the device. A complementary strap, harness, or body apparel may further be provided. The strap, harness, or body apparel may enable a user-exerciser to attach the exercise device in a hands-free manner that would enable the user-exercise to pull the exercise device while walking, jogging, or running. In a further embodiment, the exercise device may comprise a barbell that spins. In such a manner, the rotational means of the barbell may protect a user's wrists during use by improving wrist-joint flexibility.

Figure 1:
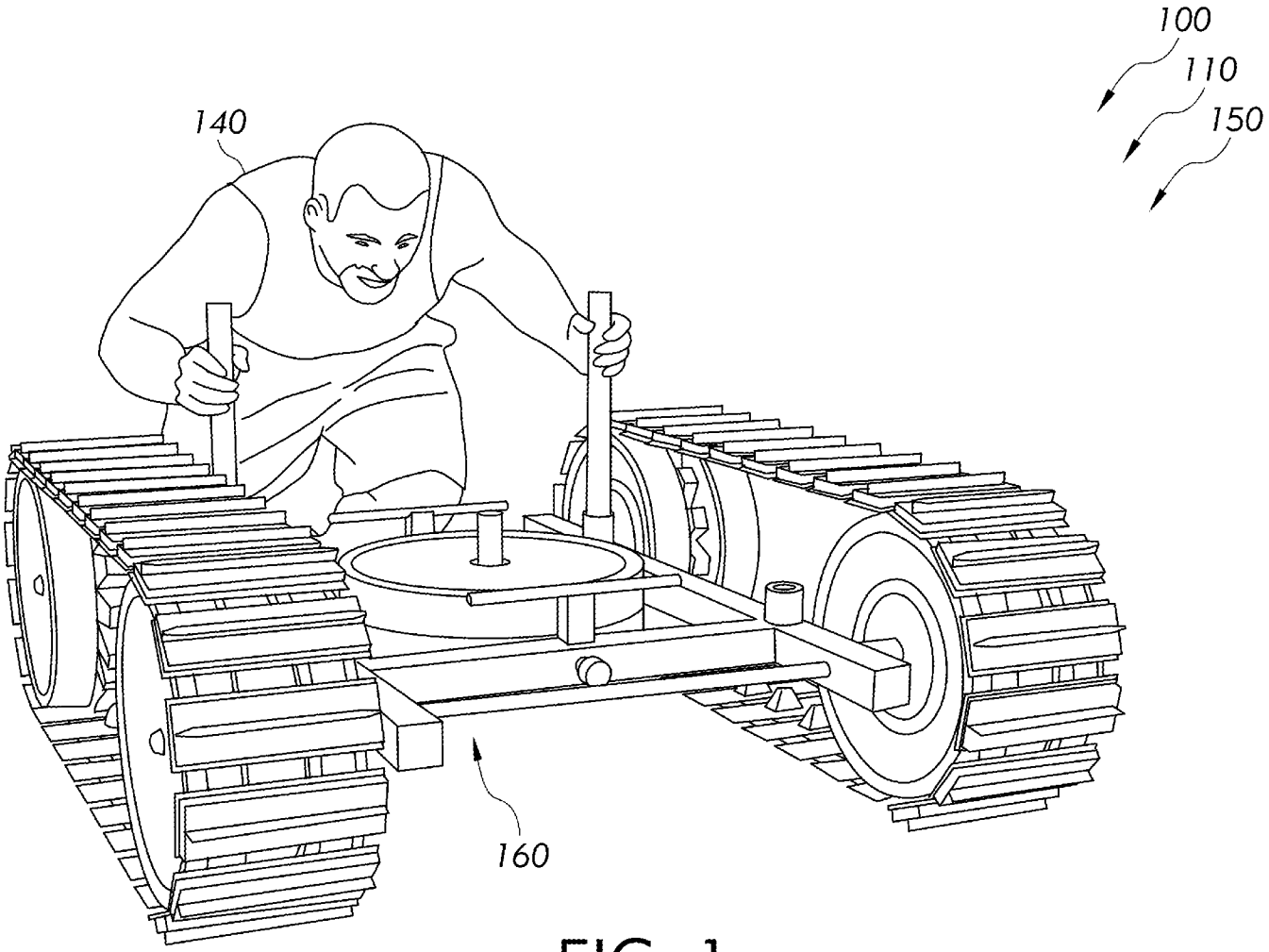
FIG. 1 shows a perspective view illustrating a modular endurance conditioning tank system during an 'in-use' condition according to an embodiment of the disclosure.

Referring now more specifically to the drawings by numerals of reference there is shown in FIG. 1 a perspective view illustrating modular endurance conditioning tank system 100 during an 'in-use' condition 150 according to an embodiment of the disclosure. Modular endurance conditioning tank system 100, in a preferred embodiment of the present disclosure, may comprise modular endurance conditioning tank assembly 110. Modular endurance conditioning tank assembly 110 is useful for user 140 to manually-maneuver steel chassis/frame assembly 160 while applying varying amounts of weights and resistance for athletic strength and endurance conditioning.

Figure 2:
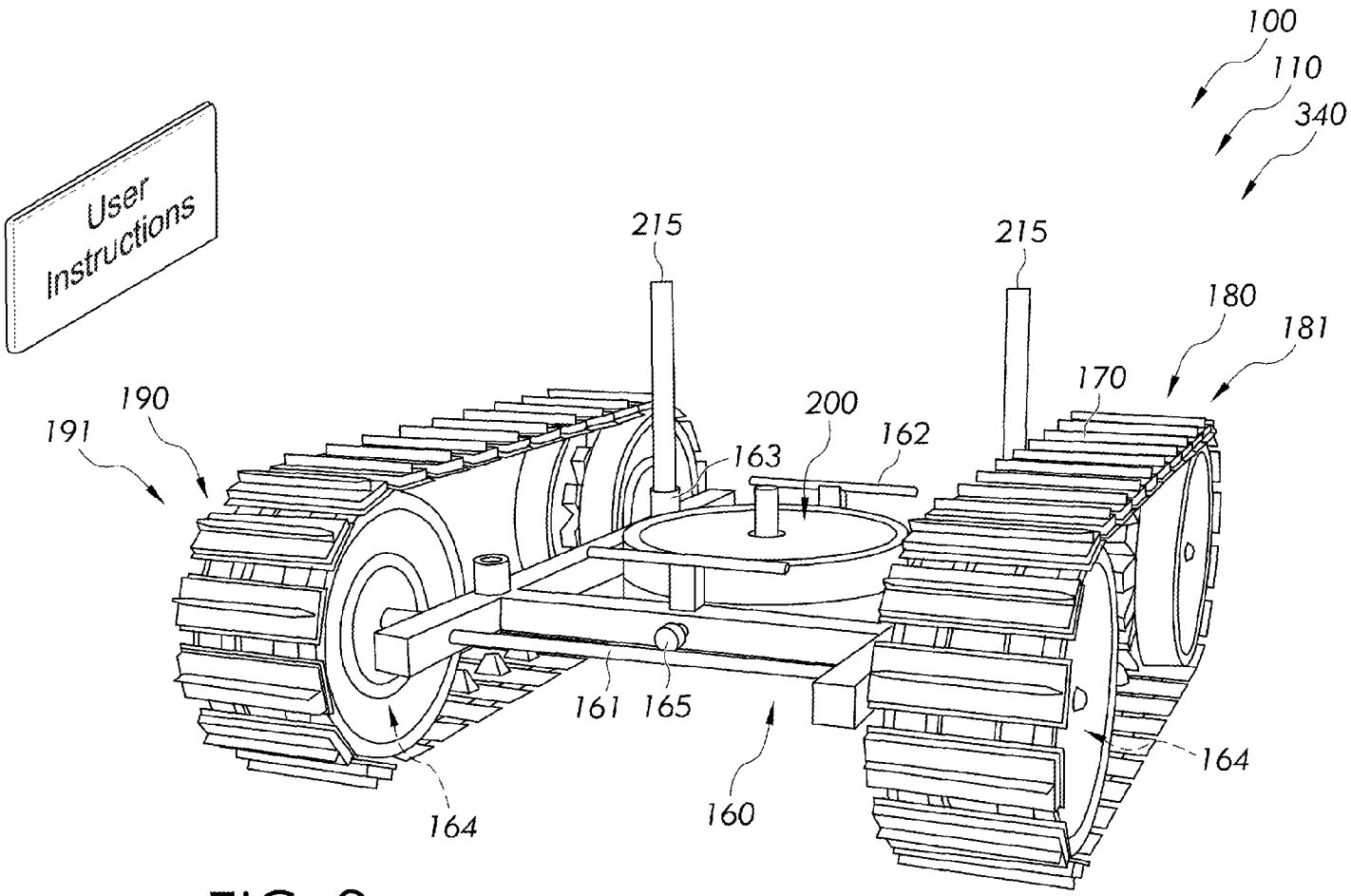
FIG. 2 is a perspective view illustrating the modular endurance conditioning tank system comprising a modular endurance conditioning tank assembly according to an embodiment of the present disclosure of the disclosure.

Referring now to FIG. 2, a perspective view illustrating modular endurance conditioning tank system 100 comprising modular endurance conditioning tank assembly 110 according to an embodiment of the present disclosure of the disclosure.

Figure 4:
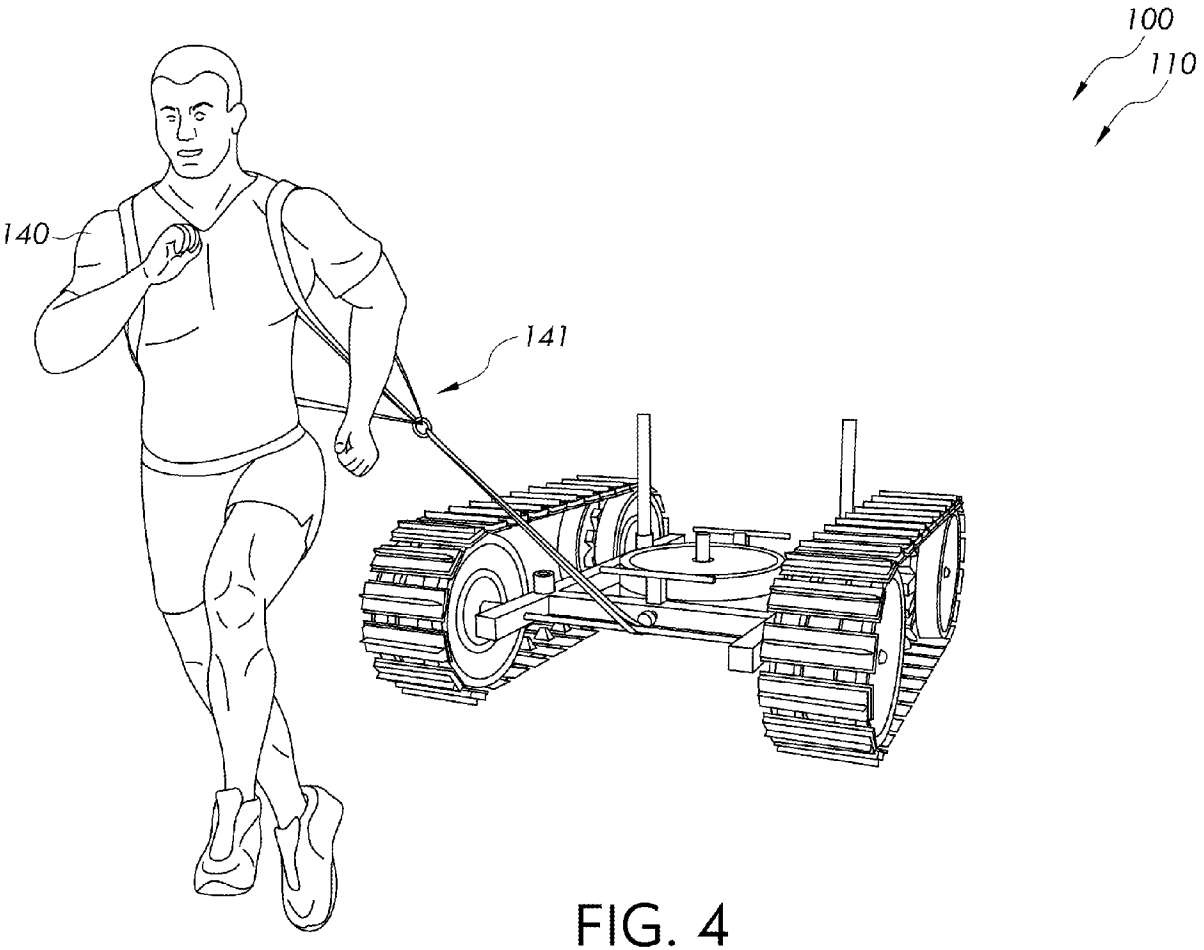
FIG. 4 is a perspective view illustrating the modular endurance conditioning tank assembly according to an embodiment of the present disclosure.

Modular endurance conditioning tank assembly 110 may comprise in functional and structural combination steel chassis/frame assembly 160, at least one wheeled continuous-track system 170, at least one steel shaft 161, T-shaped handle 162, at least one hand-hold receiver 163, barbell-weight plate receptacle 200, and complementary strap, harness, and alternatively the user-worn apparel 141 (FIG. 4). Steel chassis/frame assembly 160 may comprise at least one wheeled continuous-track system 170, and at least one wheeled continuous-track system 170 may further comprise left-track assembly 180, right-track assembly 190, and double wheel disc brake system 164. Further, double wheel disc brake system 164 may comprise a resistance adjusting knob 165.

In continuing to refer to at least one wheeled continuous-track system 170, at least one wheeled continuous-track system 170 may comprise first-continuous band of tread 181, which may be structured and arranged rotate about left-track assembly 180, and second-continuous band of tread 191, which may be structured and arranged rotate about right-track assembly 190. First-continuous band of tread 181 and second-continuous band of tread 191 are configured to enable rotational motion of modular endurance conditioning tank assembly 110.

In further referring to FIG. 2, at least one hand-hold receiver 163 may be structured and arranged to removably-couple with plurality of steel rods 215, useful for user 140 (FIG. 1) to hold and maneuver modular endurance conditioning tank assembly 110 across a surface. In another embodiment of the present disclosure, plurality of steel rods 215 may comprise curved handles. Curved handles may provide an ergonomically-correct profile for easy manipulation of the modular endurance conditioning tank system 100.

Modular endurance conditioning tank system 100 may be sold as a kit 340 comprising the following parts: at least one steel chassis/frame assembly 160; at least one plurality of steel rods 215; at least one complementary strap, harness, and alternatively body apparel 141 (FIG. 4); and at least one set of user instructions. The kit has instructions such that functional relationships are detailed in relation to the structure of the disclosure (such that the disclosure can be used, maintained, or the like in a preferred manner).

Figure 3:
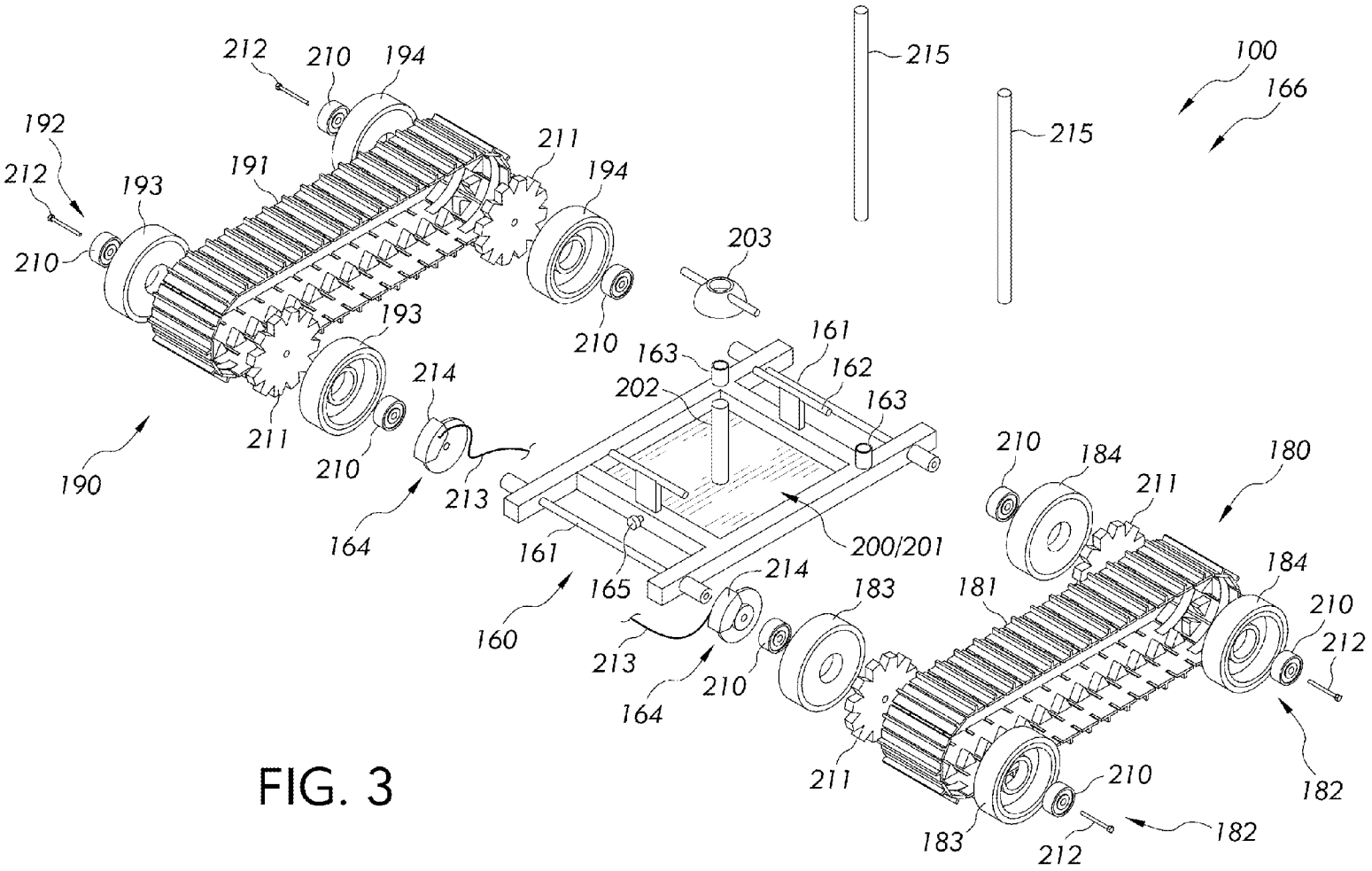
FIG. 3 is an exploded view illustrating the modular endurance conditioning tank assembly according to an embodiment of the present disclosure.

Referring now to FIG. 3 is an exploded view illustrating modular endurance conditioning tank assembly 110 according to an embodiment of the present disclosure. Left track assembly 180 may comprise first at least two rubberized and steel wheels 182, and right-track assembly 190 may comprise second at least two rubberized and steel wheels 192. First at least two rubberized and steel wheels 182 and second at least two rubberized and steel wheels 192 are structured and arranged to engage in a manner to propel modular endurance conditioning tank assembly 110 by user 140 (FIG. 4).

In continuing to refer to FIG. 3, first at least two rubberized and steel wheels 182 may comprise first-forward wheel 183 and first-rear wheel 184, and second at least two rubberized and steel wheels 192 may comprise second-forward wheel 193 and second-rear wheel 194. First-forward wheel 183, first-rear wheel 184, second-forward wheel 193, and second-rear wheel 194 are structured and arranged in square shape (configuration) 166 to frame steel chassis/frame assembly. Further, first at least two rubberized and steel wheels 182 and second at least two rubberized and steel wheels 192 may comprise plurality of roller bearings 210, useful for enabling a rotational motion of the first at least two rubberized and steel wheels 182 and second at least two rubberized and steel wheels 192.

First at least two rubberized and steel wheels 182 and second at least two rubberized and steel wheels 192 may further comprise sprockets 211 structured and arranged to mate with first-continuous band of tread 181 and second-continuous band of tread 191 such that modular endurance conditioning tank system 100 is allowed to be propelled in a forward, and alternatively, a backward direction. Further, first at least two rubberized and steel wheels 182 and second at least two rubberized and steel wheels 192 may comprise at least one bolt 212 useful for retaining at first at least two rubberized and steel wheels 182 and second at least two rubberized and steel wheels 192 to steel chassis/frame assembly 160.

In further referring to FIG. 3, double wheel disc brake system 164 may comprise cable 213 useful for actuating mechanical braking of modular endurance conditioning tank assembly 110. Double wheel disc brake system 164 may further comprise at least one caliper 214 useful for frictionally-decelerating first at least two rubberized and steel wheels 182 and second at least two rubberized and steel wheels 192. In additional embodiments of the present disclosure, alternative braking system designs may comprise side-to-side braking, pull, drum brake systems, hydraulic brake systems, and alternatively, or electrical brake systems. Further, resistance adjusting knob 165 may be structured and arranged to manually apply increased, and alternatively decreased, resistance equally to first at least two rubberized and steel wheels 182 and second at least two rubberized and steel wheels 192, useful for creating a customizable training experience. Barbell-weight plate receptacle 200 may comprise plate 201, steel pole 202, and clamp 203 configured to place at least one barbell-weight over steel pole 202 until at least one barbell-weight is coupled with plate 201, and secure at least one barbell-weight with clamp 203 in a manner useful for increasing the overall weight of modular endurance conditioning tank assembly 110.

In continuing to refer to FIG. 3, steel chassis/frame assembly 160 may comprise at least one steel shaft 161 and T-shaped handle 162, useful for performing lifting and flipping exercises. Further, at least one hand-hold receiver 163 is structured and arranged to removably-couple with plurality of steel rods 215, useful for pushing modular endurance conditioning tank assembly 110 across a surface. The at least one steel shaft 161 may be structured and arranged with roller bearings useful for allowing the at least one steel shaft 161 to spin freely such that the rotational motion of the at least one steel shaft may protect a user's 140 (FIG. 4) wrists and improve wrist joint flexibility during use. The at least one steel shaft 161 may further comprise a knurled surface, useful for promoting a slip-resistant grip.

Referring now to FIG. 4 a perspective view illustrating modular endurance conditioning tank assembly 110 according to an embodiment of the present disclosure. Complementary strap, harness, and alternatively user-worn apparel 141 is structured and arranged to allow user 140 to removably-couple with modular endurance conditioning tank assembly 110 in a hands-free manner to enable user 140 to maneuver modular endurance conditioning tank assembly 110 while walking, jogging, and alternatively running over a plurality of indoor and outdoor surfaces. In additional embodiments of the present disclosure, alternate materials and tread configurations may be employed for the continuous band of treads. Upon reading this specification, it should be appreciated that, under appropriate circumstances, considering such issues as user preferences, design preference, structural requirements, marketing preferences, cost, available materials, technological advances, etc., other modular endurance conditioning tank system arrangements such as additional arrangements to increase or decrease supplemental weights, chassis/frame assembly materials and configurations, alternative maneuvering means, etc., may be sufficient.

Modular endurance conditioning tank system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different wheeled/track combinations, parts may be sold separately, etc., may be sufficient.

Figure 5:
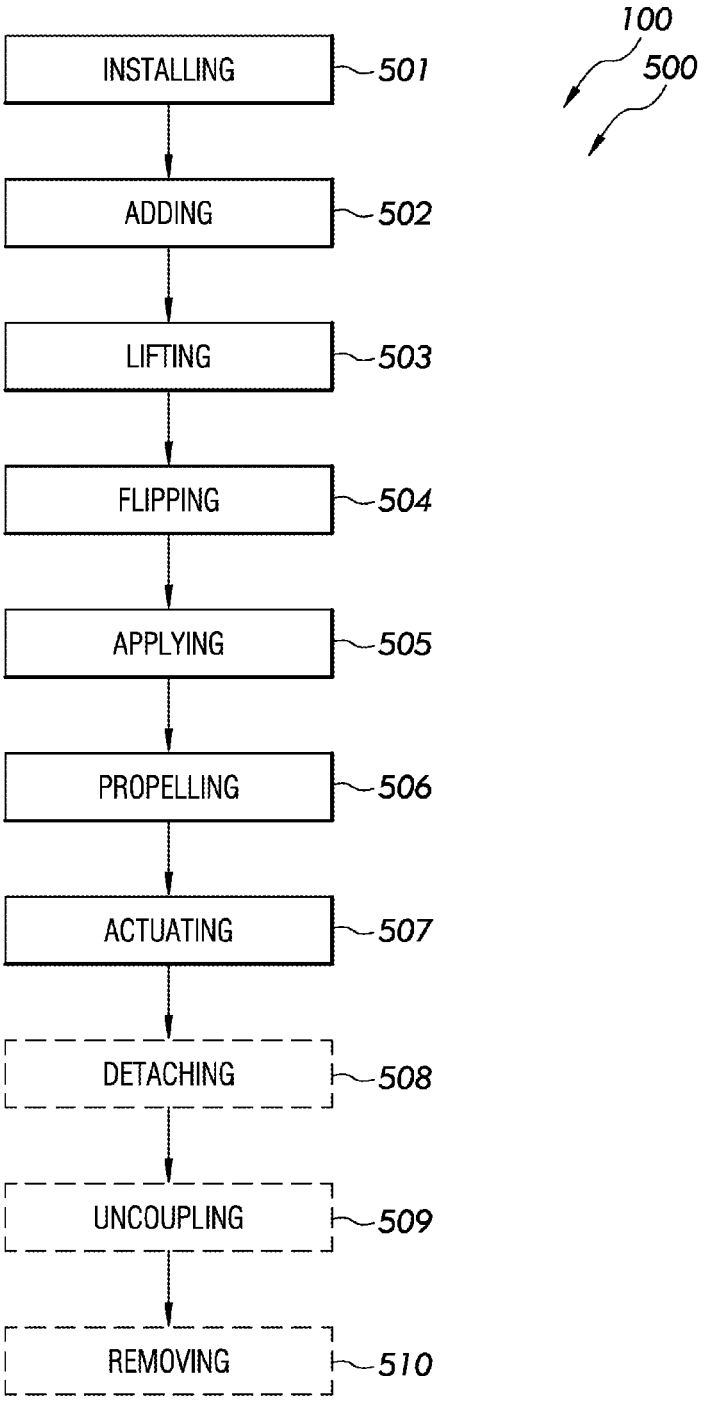
FIG. 5 is a flow diagram illustrating a method of use for the modular endurance conditioning tank system according to an embodiment of the present disclosure.

Referring now to FIG. 5 showing a flow diagram 550 illustrating method of use 500 for modular endurance conditioning tank system 100 according to an embodiment of the present disclosure of FIGS. 1-4. As shown, method of use 500 may comprise the steps of: step one 501, installing plurality of steel rods 215 in an at least one hand-hold receiver 163; step two 502, adding at least one barbell-weight to barbell-weight plate receptacle 200; step three 503, lifting steel chassis/frame assembly 160 with at least one steel shaft 161, and alternatively T-shaped handle 162; step four 504, flipping steel chassis/frame assembly 160 with 161, and alternatively T-shaped handle 162; step five 505, applying increased, and alternatively decreased, resistance equally to first at least two rubberized and steel wheels 182 and second at least two rubberized and steel wheels 192 via resistance adjusting knob 165; step six 506, propelling steel chassis/frame assembly 160 in a forward, and alternatively a backward, direction across a surface; step seven 507, actuating mechanical braking using double wheel disc brake system 164 as desired; step eight, 508 detaching plurality of steel rods 215 from at least one hand-hold receiver 163; step nine 509, uncoupling at least one barbell-weight from barbell-weight plate receptacle 200; and step ten 510, removing increased, and alternatively decreased, resistance equally from first at least two rubberized and steel wheels 182 and second at least two rubberized and steel wheels 192 via resistance adjusting knob 165.

It should be noted that steps 508, 509, and 510 are optional steps and may not be implemented in all cases. Optional steps of method of use 500 are illustrated using dotted lines in FIG. 5 so as to distinguish them from the other steps of method of use 500.

It should be noted that the steps described in the method of use can be carried out in many different orders according to user preference. The use of "step of" should not be interpreted as "step for", in the claims herein and is not intended to invoke the provisions of 35 U.S.C. §112 (f). Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the disclosure described herein are exemplary and numerous modifications, variations and rearrangements can be readily envisioned to achieve substantially equivalent results, all of which are intended to be embraced within the spirit and scope of the disclosure. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A modular endurance conditioning tank system comprising:

a modular endurance conditioning tank assembly comprising;
- a steel chassis/frame assembly having;
  - at least one wheeled continuous-track system;
    - a left-track assembly;
    - a right-track assembly;
    - a double wheel disc brake system including;
      - a resistance adjusting knob;
  - at least one steel shaft;
  - a T-shaped handle;
  - at least one hand-hold receiver;
  - a barbell-weight plate receptacle; and
  - a complementary strap, harness, and alternatively user-worn apparel;

wherein said modular endurance conditioning tank system comprises said modular endurance conditioning tank assembly;

wherein said modular endurance conditioning tank assembly comprises said steel chassis/frame assembly;

wherein said modular endurance conditioning tank assembly comprises in functional and structural combination said at least one wheeled continuous-track system, said at least one steel shaft, said T-shaped handle, said at least one hand-hold receiver, said barbell-weight plate receptacle, and said complementary strap, harness, and alternatively said user-worn apparel;

wherein said at least one wheeled track system comprises said left-track assembly, said right-track assembly, and said double wheel disc brake system;

wherein said double wheel disc brake system comprises said resistance adjusting knob; and wherein said modular endurance conditioning tank assembly is useful for manually-maneuvering said steel chassis/frame assembly while applying varying amounts of weights and resistance for athletic strength and endurance conditioning.

2. The modular endurance conditioning tank system of claim 1 wherein said at least one wheeled continuous-track system comprises a first-continuous band of tread structured and arranged rotate about said left-track assembly, and a second-continuous band of tread structured and arranged rotate about said left-track assembly to enable rotational motion of said modular endurance conditioning tank assembly.

3. The modular endurance conditioning tank system of claim 1 wherein said left track assembly comprises a first at least two rubberized and steel wheels and said right-track assembly comprises a second at least two rubberized and steel wheels wherein said first at least two rubberized and steel wheels and said second at least two rubberized and steel wheels are structured and arranged to engage in a manner to propel said modular endurance conditioning tank assembly.

4. The modular endurance conditioning tank system of claim 3 wherein said first at least two rubberized and steel wheels comprise a first-forward wheel and a first-rear wheel and said second at least two rubberized and steel wheels comprise a second-forward wheel and a second-rear wheel.

5. The modular endurance conditioning tank system of claim 4 wherein said first-forward wheel, said first-rear wheel, said second-forward wheel, and said second-rear wheel are structured and arranged in a square configuration to frame said steel chassis/frame.

6. The modular endurance conditioning tank system of claim 3 wherein said first at least two rubberized and steel wheels and second at least two rubberized and steel wheels comprise a plurality of roller bearings useful for enabling a rotational motion of said first at least two rubberized and steel wheels and second at least two rubberized and steel wheels.

7. The modular endurance conditioning tank system of claim 3 wherein said first at least two rubberized and steel wheels and second at least two rubberized and steel wheels comprise sprockets structured and arranged to mate with said at least one first-continuous band of tread and said second-continuous band of tread such that said modular endurance conditioning tank system is allowed to be propelled in a forward and alternatively a backward direction.

8. The modular endurance conditioning tank system of claim 3 wherein said first at least two rubberized and steel wheels and second at least two rubberized and steel wheels comprise at least one bolt useful for retaining said first at least two rubberized and steel wheels and said second at least two rubberized and steel wheels to said steel chassis/frame assembly.

9. The modular endurance conditioning tank system of claim 1 wherein said double wheel disc brake system comprises a cable useful for actuating mechanical braking of said modular endurance conditioning tank assembly.

10. The modular endurance conditioning tank system of claim 7 wherein said double wheel disc brake system comprises at least one caliper useful for frictionally-decelerating said first at least two rubberized and steel wheels and second at least two rubberized and steel wheels.

11. The modular endurance conditioning tank system of claim 1 wherein said resistance adjusting knob is structured and arranged to manually apply increased and alternatively decreased resistance equally to said first at least two rubberized and steel wheels and said second at least two rubberized and steel wheels useful for creating a customizable training experience.

12. The modular endurance conditioning tank system of claim 1 wherein said steel chassis/frame assembly comprises said at least one steel shaft and said T-shaped handle, useful for performing lifting and flipping exercises.

13. The modular endurance conditioning tank system of claim 1 wherein said at least one hand-hold receiver is structured and arranged to removably-couple with a plurality of steel rods, useful for pushing said modular endurance conditioning tank assembly across a surface.

14. The modular endurance conditioning tank system of claim 1 wherein said barbell-weight plate receptacle comprises a plate, a steel pole, and a clamp that are structured and arranged to place at least one barbell-weight over said steel pole until said at least one barbell-weight is coupled with said plate, and securing said at least one barbell-weight with said clamp in a manner useful for increasing an overall weight of said modular endurance conditioning tank assembly.

15. The modular endurance conditioning tank system of claim 1 wherein said complementary strap, harness, and alternatively user-worn apparel is structured and arranged to allow a user to removably-couple with said modular endurance conditioning tank assembly in a hands-free manner to enable said user to maneuver said modular endurance conditioning tank assembly while walking, jogging, and alternatively running.

16. A modular endurance conditioning tank system comprising:

a modular endurance conditioning tank assembly comprising;

a steel chassis/frame assembly having;

at least one wheeled continuous-track system;

a left-track assembly;

a right-track assembly; and a double wheel disc brake system including;

a resistance adjusting knob;

at least one steel shaft;

a T-shaped handle;

at least one hand-hold receiver;

a barbell-weight plate receptacle; and a complementary strap, harness, and alternatively user-worn apparel;

wherein said modular endurance conditioning tank system comprises said modular endurance conditioning tank assembly;

wherein said modular endurance conditioning tank assembly comprises said steel chassis/frame assembly;

wherein said modular endurance conditioning tank assembly comprises in functional and structural combination said at least one wheeled continuous-track system, said at least one steel shaft, said T-shaped handle, said at least one hand-hold receiver, said barbell-weight plate receptacle, and said complementary strap, harness, and alternatively said user-worn apparel;

wherein said at least one wheeled track system comprises said left-track assembly, said right-track assembly, and said double wheel disc brake system;

wherein said double wheel disc brake system comprises said resistance adjusting knob;

wherein said at least one wheeled continuous-track system comprises said first-continuous band of tread structured and arranged rotate about said left-track assembly, and said second-continuous band of tread structured and arranged rotate about said left-track assembly to enable rotational motion of said modular endurance conditioning tank assembly;

wherein said left track assembly comprises said first at least two rubberized and steel wheels and said right-track assembly comprises said second at least two rubberized and steel wheels wherein said first at least two rubberized and steel wheels and said second at least two rubberized and steel wheels are structured and arranged to engage in a manner to propel said modular endurance conditioning tank assembly;

wherein said first at least two rubberized and steel wheels comprise said first-forward wheel and said first-rear wheel and said second at least two rubberized and steel wheels comprise said second-forward wheel and said second-rear wheel;

wherein said first-forward wheel, said first-rear wheel, said second-forward wheel, and said second-rear wheel are structured and arranged in a square configuration to frame said steel chassis/frame;

wherein said first at least two rubberized and steel wheels and second at least two rubberized and steel wheels comprise said plurality of roller bearings useful for enabling a rotational motion of said first at least two rubberized and steel wheels and second at least two rubberized and steel wheels;

wherein said first at least two rubberized and steel wheels and second at least two rubberized and steel wheels comprise sprockets structured and arranged to mate with said first-continuous band of tread and said second-continuous band of tread such that said modular endurance conditioning tank system is allowed to be propelled in a forward and alternatively a backward direction;

wherein said first at least two rubberized and steel wheels and second at least two rubberized and steel wheels comprise at least one bolt useful for retaining said first at least two rubberized and steel wheels and said second at least two rubberized and steel wheels to said steel chassis/frame assembly;

wherein said double wheel disc brake system comprises said cable useful for actuating mechanical braking of said modular endurance conditioning tank assembly;

wherein said double wheel disc brake system comprises at least one caliper useful for frictionally-decelerating said first at least two rubberized and steel wheels and second at least two rubberized and steel wheels;

wherein said resistance adjusting knob is structured and arranged to manually apply increased and alternatively decreased resistance equally to said first at least two rubberized and steel wheels and said second at least two rubberized and steel wheels useful for creating a customizable training experience;

wherein said steel chassis/frame assembly comprises said at least one steel shaft and said T-shaped handle, useful for performing lifting and flipping exercises;

wherein said at least one hand-hold receiver is structured and arranged to removably-couple with said plurality of steel rods, useful for pushing said modular endurance conditioning tank assembly across a planar surface;

wherein said barbell-weight plate receptacle comprises said plate, said steel pole, and said clamp that are structured and arranged to place said at least one barbell-weight over said steel pole until said at least one barbell-weight is coupled with said plate, and securing said at least one barbell-weight with said clamp in a manner useful for increasing said overall weight of said modular endurance conditioning tank assembly;

wherein said complementary strap, harness, and alternatively user-worn apparel is structured and arranged to allow a user to removably-couple with said modular endurance conditioning tank assembly in a hands-free manner to enable said user to maneuver said modular endurance conditioning tank assembly while walking, jogging, and alternatively running; and wherein said modular endurance conditioning tank assembly is useful for manually-maneuvering said steel chassis/frame assembly while applying varying amounts of weights and resistance for athletic strength and endurance conditioning.

17. The modular endurance conditioning tank system of claim 16 further comprising a kit including:

said steel chassis/frame assembly;

said plurality of steel rods;

said complementary strap, harness, and alternatively body apparel; and a set of user instructions.

18. A method of using a modular endurance conditioning tank system comprising the steps of:

installing a plurality of steel rods in an at least one hand-hold receiver;

adding at least one barbell-weight to a barbell-weight plate receptacle;

lifting a steel chassis/frame assembly with at least one steel shaft and alternatively a T-shaped handle;

flipping said steel chassis/frame assembly with said at least one steel shaft and alternatively said T-shaped handle;

applying increased and alternatively decreased resistance equally to a first at least two rubberized and steel wheels and a second at least two rubberized and steel wheels via a resistance adjusting knob;

propelling said steel chassis/frame assembly in a forward and alternatively a backward direction across a surface; and actuating mechanical braking using a double wheel disc brake system as desired.

19. The method of claim 18 further comprising the steps of:

detaching said plurality of steel rods from said at least one hand-hold receiver;

uncoupling said at least one barbell-weight from said barbell-weight plate receptacle; and removing increased and alternatively decreased resistance equally from said first at least two rubberized and steel wheels and said second at least two rubberized and steel wheels via said resistance adjusting knob.

* * * * *